US010514202B2

(12) United States Patent
Ladd

(10) Patent No.: US 10,514,202 B2
(45) **Date of Patent: *Dec. 24, 2019**

(54) SYSTEMS AND METHODS FOR MULTI-STAGE REFRIGERATION

(71) Applicant: Bechtel Hydrocarbon Technology Solutions, Inc., Houston, TX (US)

(72) Inventor: David Ladd, Sugar Land, TX (US)

(73) Assignee: Bechtel Hydrocarbon Technology Solutions, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/902,206

(22) Filed: Feb. 22, 2018

(65) Prior Publication Data

US 2018/0180355 A1 Jun. 28, 2018

Related U.S. Application Data

(63) Continuation of application No. 15/754,385, filed as application No. PCT/US2017/060349 on Nov. 7, 2017, now Pat. No. 10,465,983, which is a continuation-in-part of application No. PCT/US2016/061077, filed on Nov. 9, 2016.

(60) Provisional application No. 62/252,855, filed on Nov. 9, 2015.

(51) Int. Cl.

| | |
|---|---|
| ***F25J 1/02*** | (2006.01) |
| ***F25B 1/10*** | (2006.01) |
| ***F25B 9/08*** | (2006.01) |
| ***F25J 1/00*** | (2006.01) |

(52) U.S. Cl.

CPC ..... *F25J 1/0205* (2013.01); *F25B 9/08* (2013.01); *F25B 2309/023* (2013.01); *F25J 2200/38* (2013.01); *F25J 2240/60* (2013.01)

(58) Field of Classification Search

CPC ..... F25B 9/08; F25B 2400/23; F25B 9/10

USPC ..... 62/498

See application file for complete search history.

(56) References Cited

U.S. PATENT DOCUMENTS

| | | | | |
|---|---|---|---|---|
| 4,112,700 | A | 9/1978 | Forg | |
| 5,769,926 | A * | 6/1998 | Lokhandwala | B01D 53/002 585/818 |
| 2003/0136146 | A1 | 7/2003 | Fischer-Caldedron et al. | |
| 2003/0140651 | A1* | 7/2003 | Takeuchi | F25B 1/08 62/500 |
| 2007/0163293 | A1 | 7/2007 | Ikegami et al. | |
| 2010/0139315 | A1 | 6/2010 | Ikegami et al. | |
| 2011/0289953 | A1 | 12/2011 | Alston | |

(Continued)

FOREIGN PATENT DOCUMENTS

| | | | |
|---|---|---|---|
| CN | 103776189 | A | 5/2014 |
| JP | 2009-263674 | A | 6/2011 |
| WO | 2004/111556 | A | 12/2004 |

OTHER PUBLICATIONS

Zhang, Energetic and Exergetic Analysis of an Ejector-Expansion Refrigeration Cycle Using the Working Fluid R32, Jul. 6, 2015, Entropy.*

(Continued)

*Primary Examiner* — Frantz F Jules
*Assistant Examiner* — Steve S Tanenbaum
(74) *Attorney, Agent, or Firm* — Crain, Caton and James

(57) ABSTRACT

Systems and methods for multi-stage refrigeration in mixed refrigerant and cascade refrigeration cycles using one or more liquid motive eductors in combination with a pump.

6 Claims, 5 Drawing Sheets

(56) References Cited

U.S. PATENT DOCUMENTS

| | | | | |
|---|---|---|---|---|
| 2012/0291462 | A1 | 11/2012 | Verma et al. | |
| 2013/0251505 | A1 | 9/2013 | Wang et al. | |
| 2017/0159978 | A1* | 6/2017 | Ladd | F25J 1/0205 |

OTHER PUBLICATIONS

Liu, Review on Ejector Efficiencies in Various Ejector Systems, 2014, INternation Refigeration and Air Conditioning Conference. Paper 1533.*

Zhang, Energetic and Exergetic Analysis of an Ejector-Expansion Refrigeration Cycle Using the Working Fluid R32, Jul. 6, 2015, Entropy (Year: 2015).*

Liu, Review on Ejector Efficiencies in Various Ejector Systems, 2014, INternation Refigeration and Air Conditioning Conference. Paper 1533 (Year: 2014).*

Eng. Ghassan F. Albuhairan, Examination Report, GCC Patent Application No. GC 2016-32328, dated Oct. 31, 2018, 4 pages, Patent Office of the Cooperation Council for the Arab States of the Gulf, Saudi Arabia.

Shane Thomas, International Search Report and Written Opinion, PCT Application No. PCT/US16/61077, dated Jan. 24, 2017, 6 pages, International Searching Authority, Alexandria, Virginia.

Emmanuel Duke, International Preliminary Report on Patentability, PCT Application No. PCT/US16/61077, dated Mar. 2018, 22 pages, International Preliminary Examining Authority, Alexandria, Virginia.

Blaine R Copenheaver; International Search Report and Written Opinion, PCT Application No. PCT/US17/60349, dated Jan. 18, 2018, 7 pages, International Searching Authority, Alexandria, Virginia.

Office action, dated May 28, 2019, JP2018-543292, 6 pages, Japan patent office, Japan.

Kosala Gunatillaka, Mar. 19, 2019, Examination Report No. 1, App. No. 2016354095, 3 pages, IP Australia, Australia.

Phillips Ormonde Fitzpatrick, Apr. 18, 2019, Response to Examination Report No. 1, App. No. 2016354095, 16 pages, Australia.

David Teitelbaum, Jun. 26, 2019, International Preliminary Report on Patentability, PCT/US2017/060349, 12 pages, USPTO, USA.

* cited by examiner

SYSTEMS AND METHODS FOR MULTI-STAGE REFRIGERATION

CROSS-REFERENCE TO RELATED APPLICATIONS

This application is a continuation of U.S. patent application Ser. No. 15/754,385, filed Feb. 22, 2018, which is a U.S. National Stage Application of International Application No. PCT/US17/60349, filed Nov. 7, 2017, which is a continuation-in-part of International Application No. PCT/US16/61077, filed Nov. 9, 2016, which claims priority to U.S. Provisional Application No. 62/252,855, filed Nov. 9, 2015, which are each incorporated herein by reference.

FIELD OF THE DISCLOSURE

The present disclosure generally relates to systems and methods for multi-stage refrigeration. More particularly, the present disclosure relates to multi-stage refrigeration in mixed refrigerant and cascade refrigeration cycles using one or more liquid motive eductors (also referred to as jet pumps and ejectors) in combination with a pump.

BACKGROUND

Multi-stage refrigeration processes are typically classified as either a mixed refrigerant cycle or a cascade refrigeration cycle. In the mixed refrigerant cycle, a refrigerant of specialized composition is employed to chill the fluid from ambient conditions to a state where it can be liquefied using an expansion valve.

In the typical cascade refrigeration cycle, successive expansion valves are used to gradually liquefy the fluid. The partially liquefied fluid is then distributed to a flash drum. The liquid from the flash drum is distributed for further chilling to subsequent flash drum stages. Vapors from the flash drums are compressed and condensed with a refrigerant.

In FIG. 1, a schematic diagram illustrates a conventional cascade refrigeration system 100 for ethylene export. An ethylene feed stream 101 at supercritical conditions from a pipeline is dehydrated using a two-bed dehydration unit. The dehydration unit operates in batch operation, where one bed 102 is dehydrating the ethylene feed stream 101 and the other bed 103 is regenerating. In regeneration mode, a portion of the dehydrated ethylene stream 111 from dehydration bed 102 enters a regeneration heater 104. The heated dehydrated ethylene stream 111 then enters dehydration bed 103 to regenerate dehydration bed 103. A water saturated ethylene stream 105 from dehydration bed 103 is condensed in an air cooler 106 and removed using a knock-out drum 107, which is also referred to as a separator, to separate the water saturated ethylene stream 105 and a condensed water stream 108. The water saturated ethylene stream 105 is compressed in a compressor 109 and the compressed water saturated ethylene stream 110 is returned to mix with ethylene feed stream 101.

The remaining portion of dehydrated ethylene stream 111 is chilled through three separate heat exchangers 112, 113, 114. Each heat exchanger cools the dehydrated ethylene stream 111 using a conventional propylene refrigerant system shown with dotted lines. The chilled dehydrated ethylene stream 115 is let-down to its condensation pressure at ambient conditions using let down valve 117 to produce flashed ethylene stream 118. The flashed ethylene stream 118 enters a flash drum 120, which is also referred to as an economizer, where it is mixed with a recycled ethylene stream 135 and flashed. The flashed ethylene vapor stream 122 mixes with a lower pressure compressed ethylene stream 124, which is then compressed in a compressor 125 to produce a higher pressure vapor ethylene stream 126. The vapor ethylene stream 126 is subsequently chilled through the propylene refrigerant system using three separate heat exchangers 128, 130, 132. The chilled condensed liquid ethylene stream 133 enters an accumulator 134 where any inert substances are vented in the accumulator 134 as they build up in the process and the recycled ethylene stream 135 is produced.

A liquid ethylene stream 136 from the flash drum 120 is expanded through an expansion valve 138 to produce a chilled two-phase fluid ethylene stream 140. The chilled two-phase fluid ethylene stream 140 enters another flash drum 142 where it is flashed. The flashed vapor ethylene stream 144 is mixed with a compressed ethylene stream 157 and then compressed in a compressor 145 to produce the compressed ethylene stream 124. The compressed ethylene stream 124 is then mixed with the higher pressure flashed ethylene vapor stream 122. The liquid ethylene stream 146 from flash drum 142 is expanded through another expansion valve 148 to produce a chilled two-phase fluid ethylene stream 150. The chilled two-phase fluid ethylene stream 150 enters another flash drum 152 where it is flashed. The flashed vapor ethylene stream 154 is mixed with a compressed ethylene boil-off-gas stream 163 and then compressed in a compressor 155 to produce the compressed ethylene stream 157. The liquid ethylene stream 156 is either distributed to a cryogenic tank 158 for storage or transported to another site. The ethylene boil-off-gas stream 160 from the cryogenic tank 158 is compressed in a compressor 162 to produce the compressed ethylene boil-off-gas stream 163.

While a cascade refrigeration cycle is the easiest to operate because of its reliance on a single refrigerant, it can be less energy efficient than a mixed refrigerant process. This is because a cascade refrigeration system employs staged flashes to primarily recover energy, whereas a mixed refrigerant system can be closely matched to the cooling curve of the commodity to be chilled. Traditionally, energy recovery involving the expansion valves in both processes has focused on hydraulic expanders or turbines, which add complexity and capital cost because they require mechanical equipment, hydraulic seals and a sink to utilize the recovered energy. The recovered energy is thus, not typically redeployed in the process itself. Liquid motive eductors have also been employed in refrigeration processes, but have either been used as a replacement for refrigerant compression or as a means to control the liquid refrigerant level, rather than taking advantage of the staged flashes present in a cascade refrigerant system to recover energy.

BRIEF DESCRIPTION OF THE DRAWINGS

The present disclosure is described below with references to the accompanying drawings in which like elements are referenced with like reference numerals, and in which.

DETAILED DESCRIPTION OF THE ILLUSTRATIVE EMBODIMENTS

Figure 1:
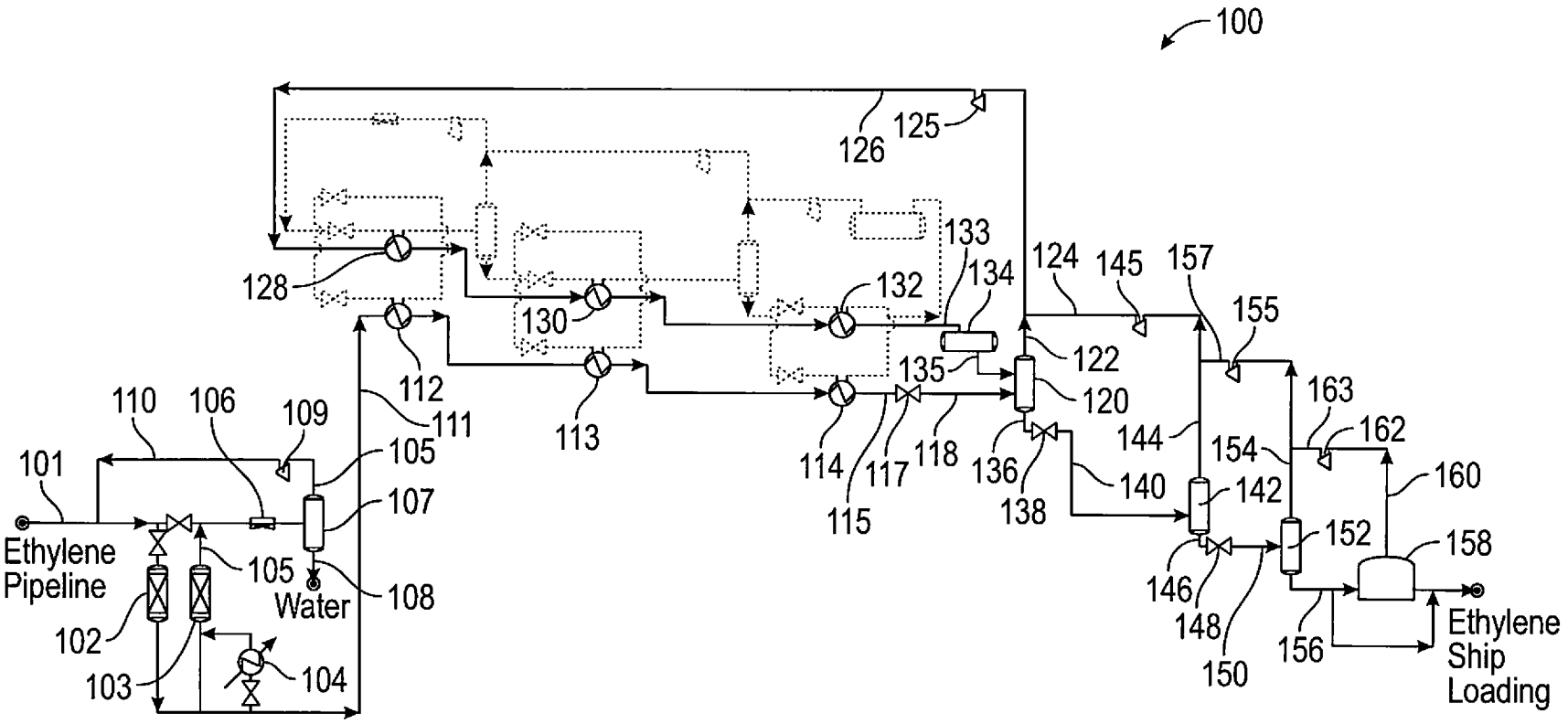
FIG. 1 (Prior Art)
FIG. 1 is a schematic diagram illustrating one embodiment of a conventional cascade refrigeration system for ethylene export.

The present disclosure overcomes one or more deficiencies in the prior art by providing systems and methods for multi-stage refrigeration in mixed refrigerant and cascade refrigeration cycles using one or more liquid motive eductors in combination with a pump.

In one embodiment, the present disclosure includes a multi-stage refrigeration system, comprising: i) an eductor in fluid communication with a first vapor line and a liquid source; ii) a flashdrum in fluid communication with the eductor, the flashdrum connected to a second vapor line, a liquid line at a bottom of the flashdrum and a two-phase fluid line; iii) a first expansion valve directly connected to the liquid line and a chilled two-phase fluid line, which is downstream from the flashdrum and the first expansion valve; iv) another flashdrum in fluid communication with the chilled two-phase fluid line and connected to the first vapor line; v) a pump positioned upstream of the eductor and in fluid communication with the liquid source, vi) another liquid line connected to the another flashdrum, vii) a second expansion valve in fluid communication with the another liquid line and connected to another chilled two-phase fluid line, viii) an accumulator connected to the another chilled two-phase fluid line and a third vapor line; and ix) another accumulator in fluid communication with the first vapor line, the second vapor line, the third vapor line and the eductor.

The subject matter of the present disclosure is described with specificity; however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will be or will become apparent to one of ordinary skill in the art upon examination of the following figures and detailed description. It is intended that all such features and advantages be included within the scope of the disclosed embodiments. Further, the illustrated figures are only exemplary and are not intended to assert or imply any limitation with regard to the environment, architecture, design, or process in which different embodiments may be implemented. To the extent that temperatures and pressures are referenced in the following description, those conditions are merely illustrative and are not meant to limit the disclosure. The various streams described herein may be carried in a line. Although the present disclosure may be implemented in certain cascade refrigeration cycles described herein, it is not limited thereto and may also be implemented in any other multi-stage refrigeration process including other cascade refrigeration cycles and mixed refrigerant cycles to achieve similar results.

Figure 2:
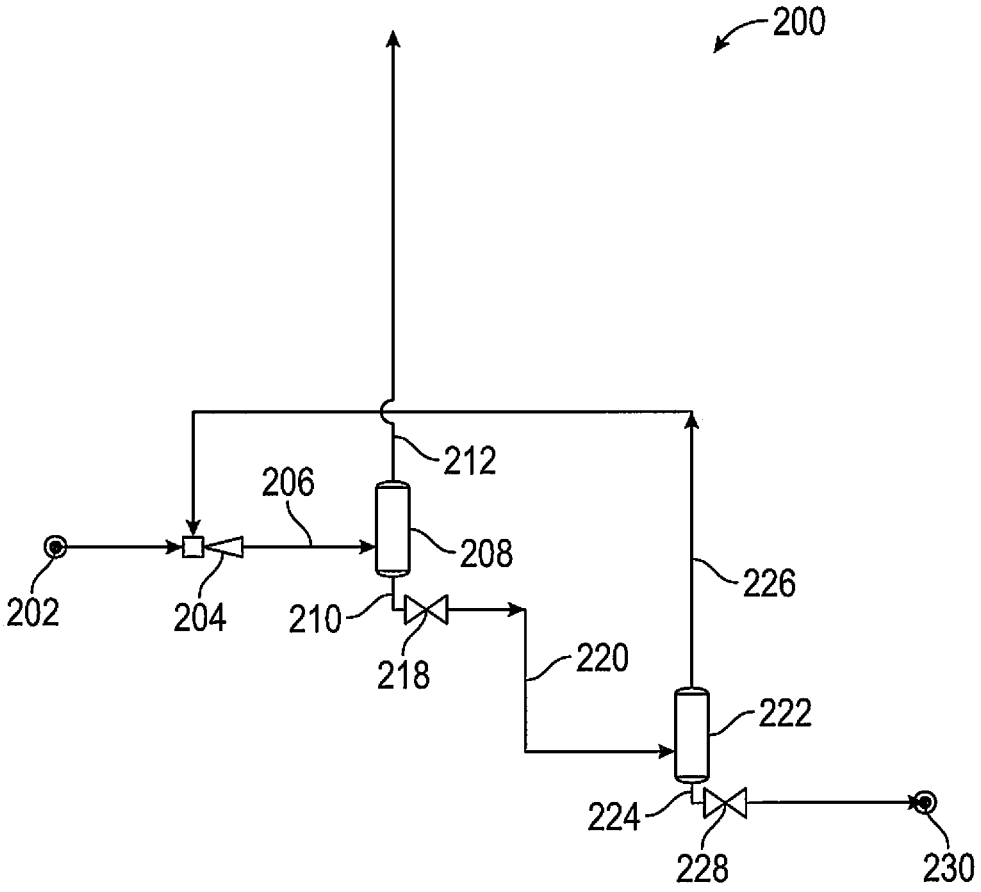
FIG. 2 is a schematic diagram illustrating one embodiment of an open multi-stage refrigeration system according to the present disclosure.

Referring now to FIG. 2, a schematic diagram illustrates one embodiment of an open multi-stage refrigeration system 200 according to the present disclosure. A source 202 supplies a liquid stream or a supercritical fluid stream to an eductor 204. A first vapor stream 226 enters the eductor 204 at a lower pressure than a pressure at the source 202 of the liquid stream or a supercritical fluid stream to achieve partial liquefaction and produce a two-phase fluid stream 206 comprising the first vapor stream 226 in a compressed state and one of the liquid stream and the supercritical fluid stream. The two-phase fluid stream 206 from the eductor 204 enters a flash drum 208 where it is flashed to produce a liquid stream 210 and a second vapor stream 212 at a higher pressure than the pressure of the first vapor stream 226. The liquid stream 210 from the flash drum 208 enters a first expansion valve 218 where it is expanded to produce a chilled two-phase fluid stream 220. The chilled two-phase fluid stream 220 enters another flash drum 222 where it is flashed to produce the first vapor stream 226 and another liquid stream 224. The another liquid stream 224 from the another flash drum 222 enters a second expansion valve 228 where it is expanded to produce another chilled two-phase fluid stream 230. The system 200 may be implemented in any multi-stage refrigeration process and utilizes one or more liquid motive eductors to raise the lower stage vapor pressure, lower the feed gas pressure and improve the energy efficiency of any multi-stage refrigeration process.

Figure 3:
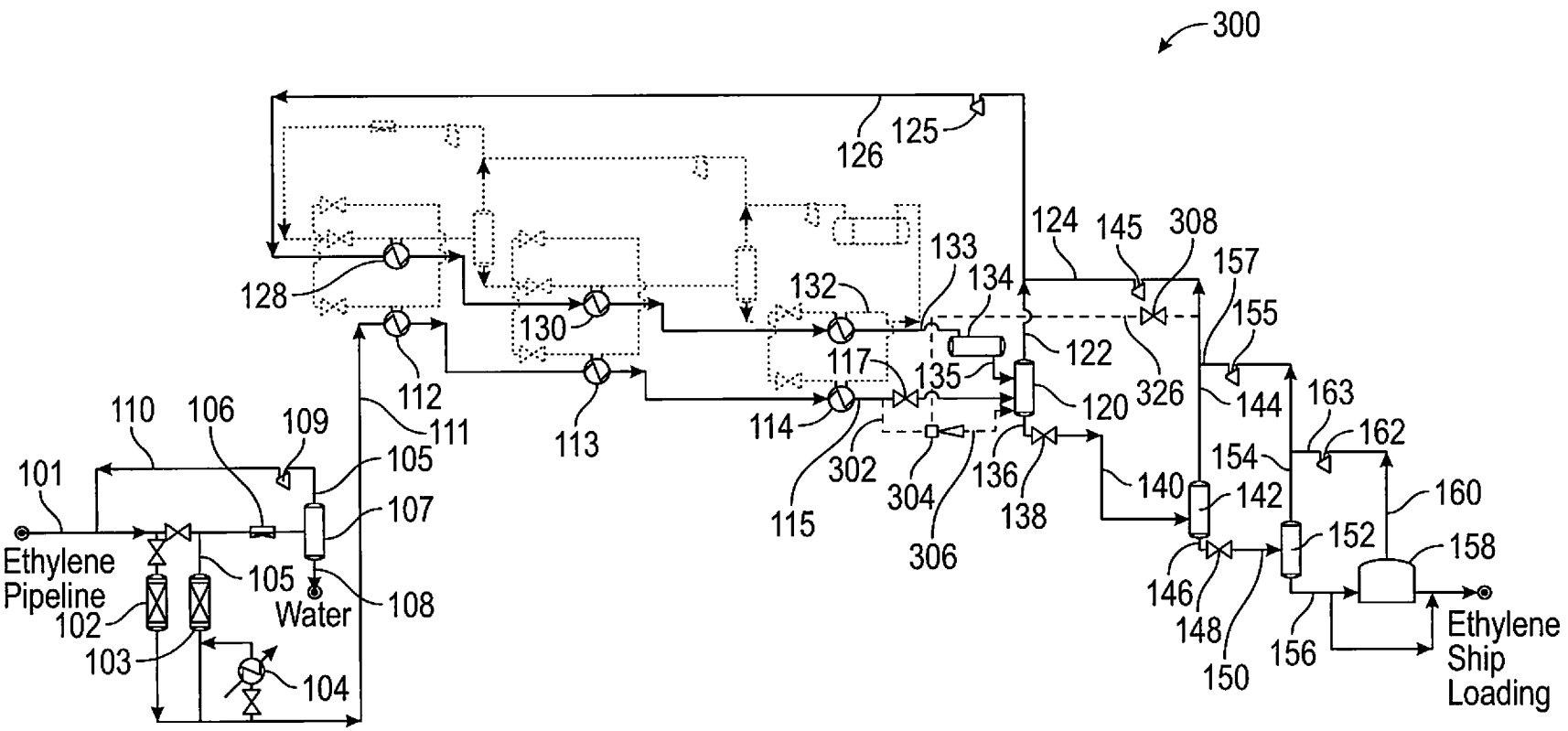
FIG. 3 is a schematic diagram illustrating one embodiment of an open multi-stage refrigeration system for producing ethylene using a preexisting cascade refrigeration cycle that is retrofitted with the system in FIG. 2.
Figure 4:
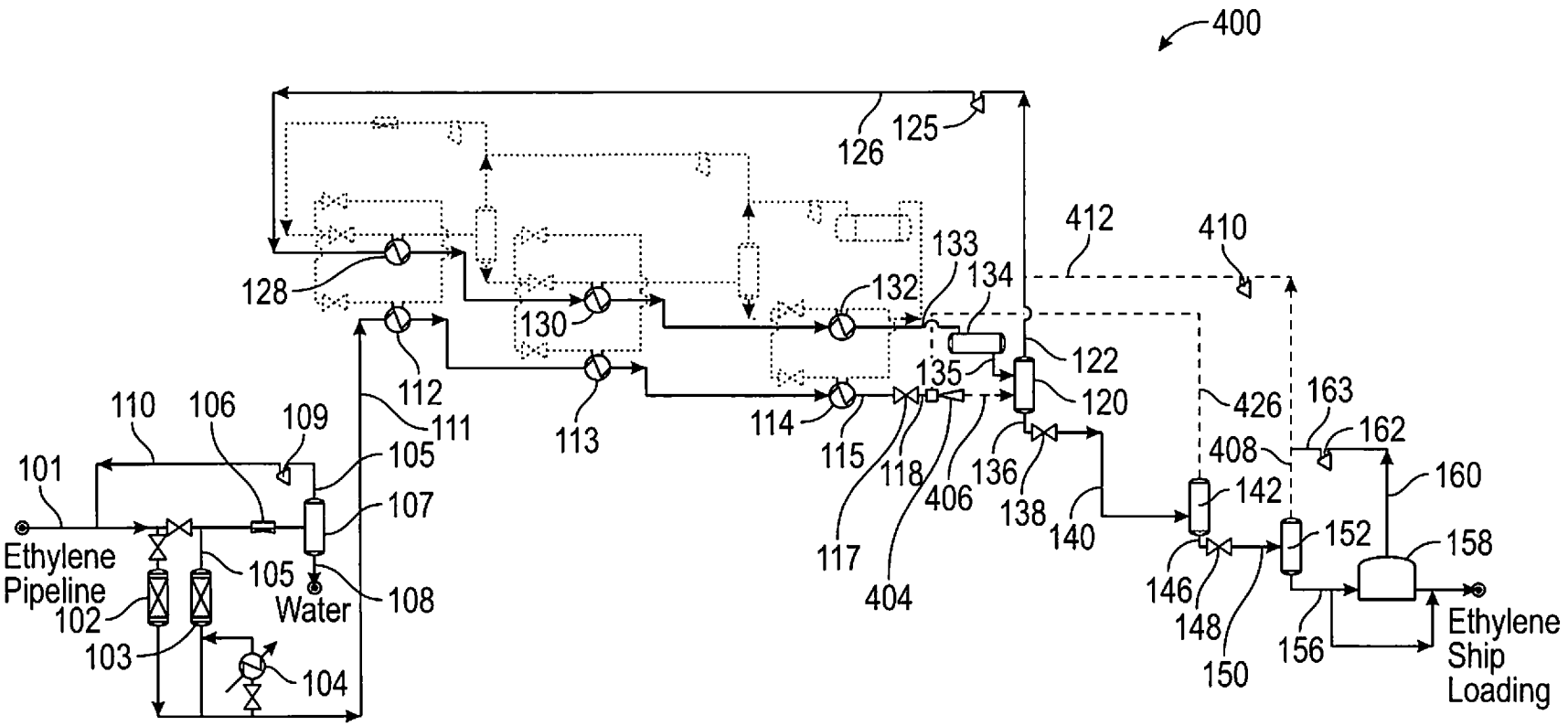
FIG. 4 is a schematic diagram illustrating one embodiment of an open multi-stage refrigeration system for producing ethylene using a cascade refrigeration cycle that is constructed with the system in FIG. 2.

The following description refers to FIGS. 3-4, which illustrate different embodiments of multi-stage refrigeration systems according to the present disclosure. In each embodiment, the system 200 illustrated in FIG. 2 is used to improve the energy efficiency of producing ethylene in a cascade refrigeration cycle. In FIG. 3, a schematic diagram illustrates one embodiment of an open multi-stage refrigeration system 300 for producing ethylene using a preexisting cascade refrigeration cycle that is retrofitted with the system 200. In FIG. 4, a schematic diagram illustrates one embodiment of an open multi-stage refrigeration system 400 for producing ethylene using a cascade refrigeration cycle that is constructed with the system 200. Each system 300, 400 in FIGS. 3-4, respectively, illustrates new components used in the system 200 with a dashed line to distinguish the components used in the conventional cascade refrigeration system 100 in FIG. 1. The system 200 therefore, may be easily implemented in different preexisting and newly constructed multi-stage refrigeration systems.

Referring now to FIG. 3, the system 300 includes a source 302 that supplies a liquid stream or a supercritical fluid stream to an eductor 304. In this embodiment, the source 302 is a portion of the chilled dehydrated ethylene stream 115. An ethylene vapor stream 326 enters the eductor 304 at a pressure about thirty-four times lower than a pressure at the source 302 of the liquid stream or a supercritical fluid stream to achieve partial liquefaction and produce a two-phase ethylene fluid stream 306 comprising the ethylene vapor stream 326 in a compressed state and one of the liquid stream and the supercritical fluid stream. The two-phase ethylene fluid stream 306 from the eductor 304 enters the flash drum 120 where it is flashed to produce a liquid ethylene stream 136 and a flashed ethylene vapor stream 122 at a pressure about four times higher than the pressure of the ethylene vapor stream 326. The liquid ethylene stream 136 from the flash drum 120 enters an expansion valve 138 where it is expanded to produce a chilled two-phase fluid ethylene stream 140. The chilled two-phase fluid ethylene stream 140 enters another flash drum 142 where it is flashed to produce the flashed vapor ethylene stream 144 and another liquid ethylene stream 146. A portion of the flashed vapor ethylene stream 144 is expanded in a new expansion valve 308 to produce the ethylene vapor stream 326. The another liquid ethylene stream 146 from the flash drum 142 enters another expansion valve 148 where it is expanded to produce another chilled two-phase fluid ethylene stream 150.

Referring now to FIG. 4, the system 400 includes a source that supplies a liquid stream or a supercritical fluid stream to an eductor 404. In this embodiment, the source is the flashed ethylene stream 118. An ethylene vapor stream 426 enters the eductor 404 at a pressure about thirty-four times lower than a pressure at the source of the liquid stream or a supercritical fluid stream to achieve partial liquefaction and produce a two-phase ethylene fluid stream 406 comprising the ethylene vapor stream 426 in a compressed state and one of the liquid stream and the supercritical fluid stream. The two-phase ethylene fluid stream 406 from the eductor 404 enters the flash drum 120 where it is flashed to produce a liquid ethylene stream 136 and a flashed ethylene vapor stream 122 at a pressure about four times higher than the pressure of the ethylene vapor stream 426. The liquid ethylene stream 136 from the flash drum 120 enters an expansion valve 138 where it is expanded to produce a chilled two-phase fluid ethylene stream 140. The chilled two-phase fluid ethylene stream 140 enters another flash drum 142 where it is flashed to produce the ethylene vapor stream 426 and another liquid ethylene stream 146. The another liquid ethylene stream 146 from the flash drum 142 enters another expansion valve 148 where it is expanded to produce another chilled two-phase fluid ethylene stream 150. The chilled two-phase fluid ethylene stream 150 enters another flash drum 152 where it is flashed. A flashed vapor ethylene stream 408 is mixed with a compressed ethylene boil-off-gas stream 163 and then compressed in a compressor 410 to produce a compressed ethylene stream 412. The flashed ethylene vapor stream 122 mixes with the lower pressure compressed ethylene stream 412, which is then compressed in a compressor 125 to produce a higher pressure vapor ethylene stream 126.

Figure 5:
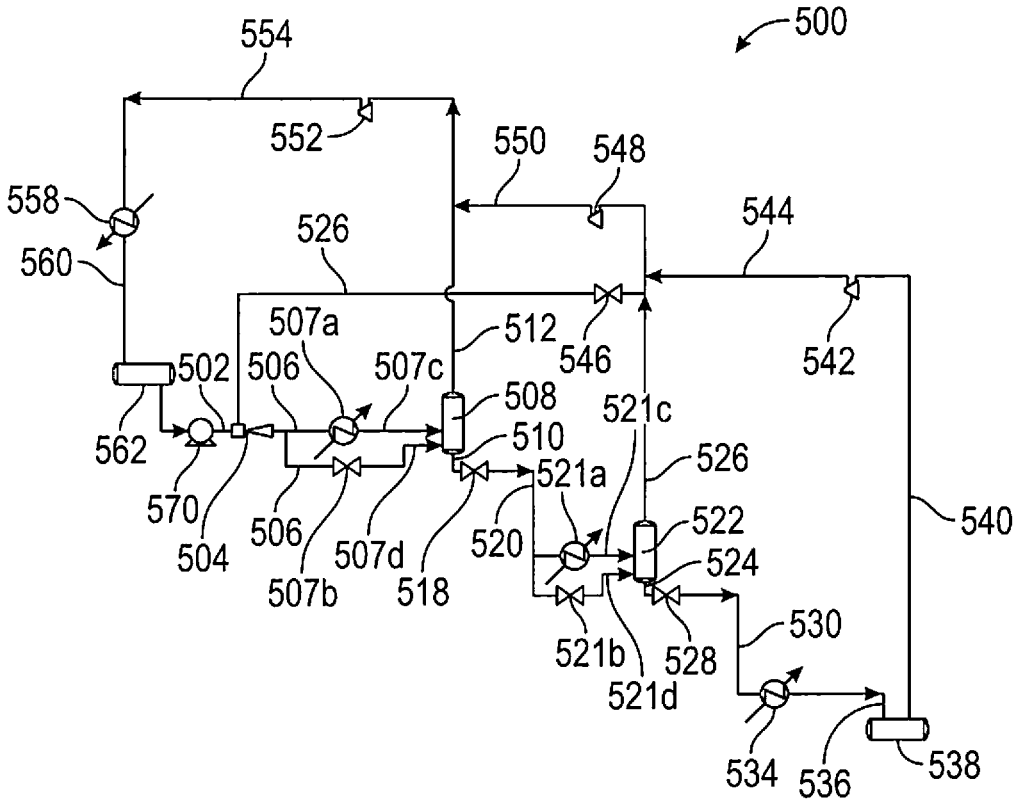
FIG. 5 is a schematic diagram illustrating one embodiment of a closed multi-stage refrigeration system according to the present disclosure.

Referring now to FIG. 5, a schematic diagram illustrates one embodiment of a closed multi-stage refrigeration system 500 according to the present disclosure. The system 500 includes a source 502 of a liquid stream or a supercritical fluid stream from an accumulator 562 that is supplied to an eductor 504. A first vapor stream 526 enters the eductor 504 at a lower pressure than a pressure at the source 502 of the liquid stream or a supercritical fluid stream to achieve partial liquefaction and produce a two-phase fluid stream 506 comprising the first vapor stream 526 in a compressed state and one of the liquid stream and the supercritical fluid stream. A portion of the two-phase fluid stream 506 from the eductor 504 enters a first heat exchanger 507*a* where it is vaporized to produce a vaporized refrigerant 507*c* and another portion of the two-phase fluid stream 506 from the eductor 504 enters a first expansion valve 507*b* where it is expanded to produce a partially expanded refrigerant 507*d*. The vaporized refrigerant 507*c* and the partially expanded refrigerant 507*d* enter a flash drum 508 where they are mixed and flashed to produce a liquid stream 510 and a second vapor stream 512 at a higher pressure than the pressure of the first vapor stream 526. The liquid stream 510 from the flash drum 508 enters a second expansion valve 518 where it is expanded to produce a chilled two-phase fluid stream 520. A portion of the chilled two-phase fluid stream 520 from the second expansion valve 518 enters a second heat exchanger 521*a* where it is vaporized to produce another vaporized refrigerant 521*c* and another portion of the chilled two-phase fluid stream 520 from the second expansion valve 518 enters a third expansion valve 521*b* where it is expanded to produce another partially expanded refrigerant 521*d*. The another vaporized refrigerant 521*c* and the another partially expanded refrigerant 521*d* enter another flash drum 522 where they are mixed and flashed to produce a third vapor stream 526 and another liquid stream 524. The another liquid stream 524 from the another flash drum 522 enters a fourth expansion valve 528 where it is expanded to produce another chilled two-phase fluid stream 530. The another chilled two-phase fluid stream 530 enters a third heat exchanger 534 where it is vaporized to produce another vaporized refrigerant 536. The another vaporized refrigerant 536 enters another accumulator 538 where any residual condensation is retained to produce a completely vaporized refrigerant 540. The completely vaporized refrigerant 540 enters a first compressor 542 and is compressed to produce a compressed refrigerant 544. The compressed refrigerant 544 is mixed with all or a portion of the third vapor stream 526 before entering a second compressor 548 to produce another compressed refrigerant 550 at a higher pressure. A portion of the third vapor stream 526 may be directed to pass through control valve 546 where it is directed to enter the eductor 504. The another compressed refrigerant 550 is mixed with the second vapor stream 512 before entering a third compressor 552 where it is compressed to produce another compressed refrigerant 554. The another compressed refrigerant 554 enters a fourth heat exchanger 558 where it is condensed to produce a liquid refrigerant 560. The liquid refrigerant 560 enters the accumulator 562 where any residual vapor is retained and is then dispensed at saturated liquid conditions to the suction of a pump 570. The pump 570 discharges high pressure liquid to produce the source 502 of a liquid stream or a supercritical fluid stream at a pressure of at least 600 psig. The system 500 may be implemented in any multi-stage refrigeration process and utilizes one or more liquid motive eductors to raise the lower stage vapor pressure, lower the feed gas pressure and improve the energy efficiency of any multi-stage refrigeration process.

EXAMPLES

As demonstrated by the comparison of simulated data in Table 1 below, the power consumption in holding mode for producing ethylene is noticeably less using the open multi-stage refrigeration system illustrated in FIG. 3 compared to the conventional cascade refrigeration system illustrated in FIG. 1. The holding mode represents the cryogenic tank when the process is producing ethylene and filling the tank in preparation for ship loading. Likewise, the comparison of simulated data in Table 2 below demonstrates the power consumption in holding mode for producing ethane is noticeably less using the open multi-stage refrigeration system illustrated in FIG. 2 for producing ethane compared to a conventional cascade refrigeration system for producing ethane.

TABLE 1

| | | FIG. 1 | FIG. 3 |
|---|---|---|---|
| Feed Rate | t/hr | 60 | 60 |
| Inlet pressure | Psig | 950 | 950 |
| Refrigerant Cooling Duty | MMBtu/hr | 17.4 | 17.2 |
| Power Consumption (Holding Mode) | Hp | 8993 | 8060 |

TABLE 2

| | | Conventional Cascade Refrigeration Cycle | FIG. 2 |
|---|---|---|---|
| Feed Rate | t/hr | 57 | 57 |
| Inlet pressure | psig | 1200 | 1200 |
| Power Consumption (Holding Mode) | hp | 7,682 | 7,013 |

Table 3 below is based on HYSYS simulations of an ethylene-based refrigeration system in an ethylene plant. After implementing a liquid motive eductor-based system into the design, a power consumption savings of about 1% is realized. But when a pump is incorporated into the design to raise the saturated liquid to a higher pressure (approximately 6 times the lowest stage pressure) for service as motive fluid, a power consumption savings of about 2% is realized. This is due to the fact that the eductor operates on the principle of differential pressure, and a higher inlet pressure on the liquid motive side facilitates more low pressure vapor compression capacity.

TABLE 3

| Technology | | Conventional | Reduced Energy Design (without pump) | Reduced Energy Design (with pump) |
|---|---|---|---|---|
| Ethylene Production Rate | tpa | 1,000 | 1,000 | 1,000 |
| Ethylene Refrigeration System Power Consumption | hp | 8,300 | 8,249 | 8,151 |

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A multi-stage refrigeration system, comprising:

an eductor in fluid communication with a first vapor line and a liquid source;

a flashdrum in fluid communication with the eductor, the flashdrum connected to a second vapor line, a liquid line at a bottom of the flashdrum and a two-phase fluid line;

a first expansion valve directly connected to the liquid line and a chilled two-phase fluid line, which is downstream from the flashdrum and the first expansion valve;

another flashdrum in fluid communication with the chilled two-phase fluid line and connected to the first vapor line;

a pump positioned upstream of the eductor and in fluid communication with the liquid source, another liquid line connected to the another flashdrum;

a second expansion valve in fluid communication with the another liquid line and connected to another chilled two-phase fluid line;

an accumulator directly connected to a vaporized refrigerant line and a third vapor line; and another accumulator in fluid communication with the first vapor line, the second vapor line, the third vapor line and the eductor.

2. The system of claim 1, wherein a pressure at the liquid source is higher than a pressure in the first vapor line.

3. The system of claim 2, wherein the pressure at the liquid source is at least thirty-four times higher than the pressure in the first vapor line.

4. The system of claim 1, wherein the liquid source comprises ethylene.

5. The system of claim 1, wherein the liquid source comprises ethane.

6. The system of claim 1, wherein a pressure in the first vapor line is at least four times lower than a pressure in the second vapor line.

* * * * *